United States Patent [19]

Barron

[11] 4,285,261

[45] Aug. 25, 1981

[54] PIANOHARP ACTION

[76] Inventor: Ellis Barron, 7228 Eads Ave., La Jolla, Calif. 92037

[21] Appl. No.: 125,676

[22] Filed: Feb. 28, 1980

[51] Int. Cl.[3] ..... G10D 3/16

[52] U.S. Cl. ..... 84/258; 84/320

[58] Field of Search ..... 84/8, 258, 320, 321, 84/404, 409

[56] References Cited

U.S. PATENT DOCUMENTS

| | | | |
|---|---|---|---|
| 479,672 | 7/1892 | Smith | 84/320 |
| 4,099,440 | 7/1978 | Barron | 84/258 |

FOREIGN PATENT DOCUMENTS

| | | | |
|---|---|---|---|
| 202737 | 10/1908 | Fed. Rep. of Germany | 84/258 |

*Primary Examiner*—Lawrence R. Franklin

[57] ABSTRACT

An improvement in the action for that type of plectrum piano which uses a pneumatic piston to provide a variable pluck loudness. The pneumatic piston is joined by a connecting rod to a crank arm on a rotatable pick body, the latter being driven vertically past a vibratable element when the instrument is played. The plectrum is mounted below the center of rotation of the pick body and describes both a lateral and a vertical motion during the pluck stroke, the pluck loudness being proportional to stroke velocity. The improvement includes the use of a gravity acting ball valve joint between the connecting rod and the piston to provide the repeat function.

5 Claims, 5 Drawing Figures

PIANOHARP ACTION

BACKGROUND OF THE INVENTION

This invention relates to improvements in the action for keyboard instruments of the harpsichord or plectrum piano type wherein the strings or vibratable elements therein are set in motion by a pick or plectrum. In particular, the invention relates to an improved means of providing such instruments with the "piano-forte" or soft-loud effect, that is, the effect wherein the player can vary the loudness of individual tones by applying more or less force at the keyboard. In a previous disclosure (U.S. Pat. No. 4,099,440) I described an action which utilized the resistance of a pneumatic piston to provide such an effect. In the present disclosure I describe a new and improved means of implementing such pneumatic actions which eliminates the noise previously associated therewith and which allows a more pleasing appearance of the instrument by eliminating that part of the action suspended below the keyboard. Furthermore, my new action utilizes a direct connecting rod between the pneumatic piston and the plectrum and the rod is constructed so as to also serve as part of the repeat valve, thus simplifying the previous design.

SUMMARY OF THE IMPROVEMENTS:

The essential element of my new action is a rotatable pick body which carries the plectrum below or eccentric to the pick body center. Thus lateral plectrum motion, necessary for escapement can be provided by rotation rather than by lateral motion of the pick body. This results in a quieter action. Such rotation is provided by placing the pneumatic piston directly above a crank arm on the pick body, the crank arm extending in a direction opposite that of the plectrum. When the instrument is played the pick body is raised past the musical string or vibratable element and the resistance to this motion presented by the pneumatic piston rotates the plectrum into the musical element. The amount musical tone produced is proportional to the force exerted at the keyboard.

In the description which follows I show two embodiments of my improved plectrum action. The first is suitable for instruments where the vibratable element is of limited length and can be plucked from the front. Such elements are appropriate for instruments using electronic amplification. The alternate embodiment shown is for instruments of the conventional accoustic type, where the strings are relatively long and parallel to the keys, and are plucked from the side.

DETAILED DESCRIPTION OF THE INVENTION

Figure 1:
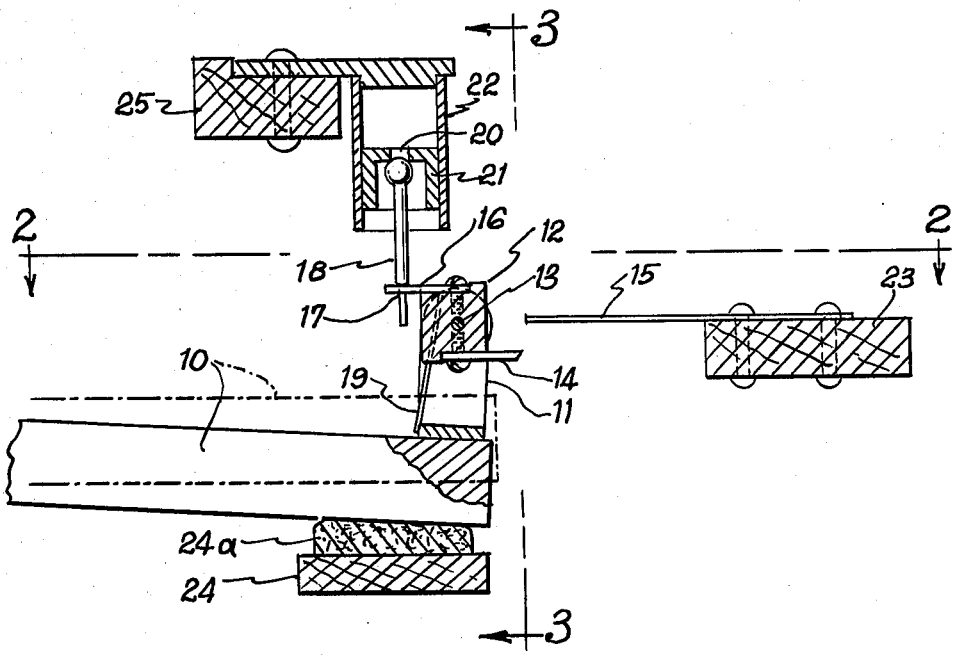
FIG. 1 is a side view of my improved plectrum action for instruments where the vibratable element is plucked from the front. I show the action for a single element or note, the parts being repeated for the other notes of the instrument. I show only the rear end of the conventional key lever, that being the end opposite the player's fingers which rises when the instrument is played. The raised position is shown in phantom line. To show the action most clearly, the pneumatic piston and cylinder are shown as a section view. Also shown in section are the key lever and cylinder support members and the member supporting the vibratable element.
Figure 2:
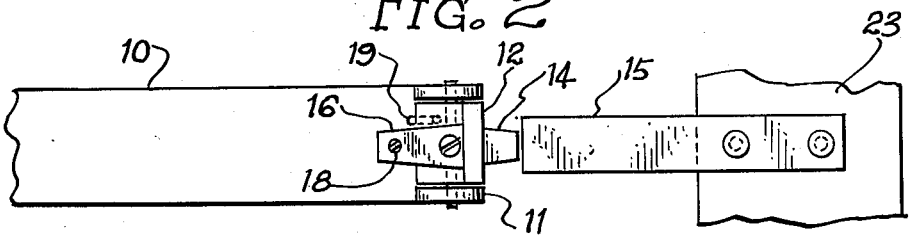
FIG. 2 is a view of the action from above, showing the end of the key lever, the plectrum, and the vibratable element. The view is taken through the plane 2—2 of FIG. 1.
Figure 3:
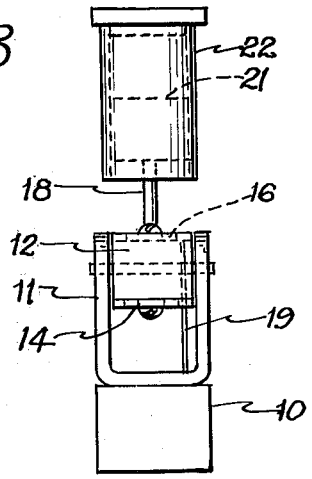
FIG. 3 is a view through 3—3 of FIG. 1, that is, a view of the action from the rear.

For a detailed desription of my improved plectrum action attention is directed first to FIGS. 1, 2, and 3, where I show as 10 the rearward portion of the conventional key lever which rises as the instrument is played. I show as 24 the conventional key lever rear support, and as **24*a*, the co-acting felt pad. Attached to key lever 10 is yoke 11 which supports the rotatable pick body 12 on axle 13. Fixed to the under side of pick body 12 is plectrum 14 which plucks the vibratable element 15 during the pluck stroke. The vibratable element is fixed in the instrument on support 23. Attached to the upper side of the pick body is crank arm 16, containing hole 17, which receives a shoulder on connecting rod 18. Determining the rest position of pick body 12 is retainer spring 19, fixed in a slot in the pick body and bearing against the bottom of yoke 11. The upper end of connecting rod 18 is formed in a spherical shape to engage and close aperture 20 in the pneumatic piston 21, the latter sliding in co-acting closed cylinder 22, fixed on support 25**.

The operation of my improved action is now most easily described by considering the two extremes of key lever velocity. First, for extremely low velocities, it can be seen that as key lever end 10 rises, spring 19 acting through the pick body 12, crank arm 16, and connecting rod 18, will raise piston 21 in cylinder 22, air escaping therefrom between the piston and cylinder walls. Because the pneumatic pressure is low for this low velocity, pick body 12 will describe very little rotation, and plectrum 14 will move past vibratable element 15 without any, or with very little, contact therewith. This condition would represent the minimum touch velocity. On the other hand, if key lever 10 is made to rise very rapidly by heavy playing, very little air will escape the cylinder, and pick body 12 will have maximal rotation, causing maximum pluck action on the vibratable element 15. The return stroke of my improved action can be described as follows. When the player releases the key, key lever end 10 falls, allowing the action parts to fall also, including connecting rod 18. The piston aperture 20 is thus uncovered, allowing air to enter the cylinder and allowing piston 21 to fall freely also, the piston being prepared immediately therefore to provide a resistance force for the next pluck stroke. The connecting rod to piston connection thus constitutes a simple gravity acting repeat valve.

Figure 4:
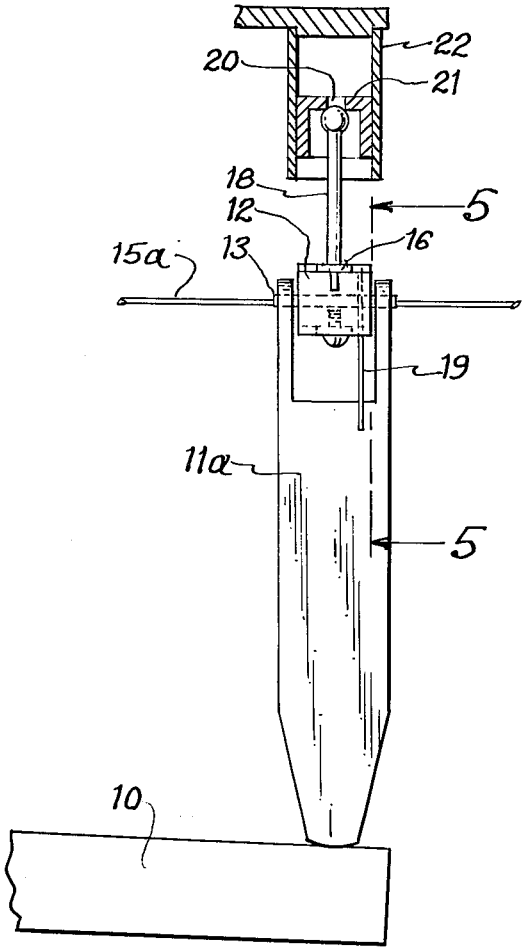
FIG. 4 is a side view of an alternate embodiment of my improved action for instruments where the vibratable element lies in a position parallel to the key lever and is therefore plucked from the side. This is the case for the conventional harpsichord type instrument where the vibratable element is a musical string. Here again I show only the rear portion of the key lever and I have omitted showing the key lever and cylinder support members as they are the same as in FIG. 1. Also, not shown are the action guides, or registers, as they are the same as in the conventional harpsichord. I have shown the pneumatic piston and cylinder again in section.
Figure 5:
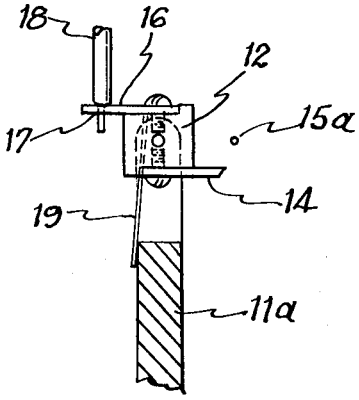
FIG. 5 is a fragmentary rear view of the action as taken through 5—5 of FIG. 4.

Referring now to FIGS. 4 and 5, I show the alternate form of my improved action for instruments where the vibratable element lies in a position parallel to the key lever. Yoke 11 of the previous embodiment is turned 90 degrees and is shown as yoke 11*a* which is raised by the key lever 10 when the instrument is played. The vibratable element in this embodiment is shown as a musical string 15*a*. The other parts of the action are identical to those of the first described embodiment and the operation of the action parts is the same as hereinbefore described.

The foregoing completes a description of my improved plectrum piano action and is representative only of the herein described elements of my invention, there being other embodiments, changes or modifications which will occur to those skilled in the art. This disclosure is intended to extend to such other embodiments or modifications as fall within the scope of the following subjoined claims.

I claim:

1. In a keyboard type musical instrument having a frame and a plurality of vibratable elements, a plucking means for each element thereof comprising:

(a) a pick body;

(b) a key-lever means rotatably carrying said pick body and providing translational motion thereof relative to said vibratable element, said translational motion having a pluck direction and a return direction;

(c) a plectrum fixed to said pick body for plucking said vibratable element, said plectrum mounted eccentric to the center of rotation of said pick body for the purpose of providing plectrum escape motion, said escape motion being at right angles to said translational motion;

(d) a crank arm also fixed to said pick body;

(e) a resilient means opposing the rotation of said pick body and determining the rest position thereof;

(f) a pneumatic piston having an aperture, said piston sliding in a co-acting closed cylinder, said cylinder supported in a fixed position on said frame adjacent to said pick body; and (g) a connecting rod connecting said crank arm to said piston, an end portion of said connecting rod engaging said piston and closing said aperture upon translational motion in the pluck direction and opening said aperture in the return direction, for the purpose of providing the plucking and escape motions.

2. A plucking means according to claim 1 wherein said keylever means includes a yoke and said pick body is rotatably mounted in said yoke, and said resilient means is mounted on and between said pick body and said yoke.

3. A plucking means according to claim 1 wherein said crank arm and said plectrum are fixed on opposite sides of said pick body and extend in opposite directions therefrom, so that said pneumatic piston is active in a direction opposite the plectrum plucking direction.

4. A plucking means according to claim 1 wherein said end portion of said connecting rod is spherically shaped so that said aperture is closed independent of the alignment of said connecting rod.

5. A plucking means according to claim 1 wherein said aperture is centered in an end of said piston for dynamic balance and for ease in manufacture.

* * * * *